US005215451A

United States Patent [19]

Hara et al.

[11] Patent Number: 5,215,451

[45] Date of Patent: Jun. 1, 1993

[54] SCROLL TYPE COMPRESSOR HAVING STEPPED ASSEMBLING PORTIONS ON THE CENTER SHELL

[75] Inventors: Shoichiro Hara, Amagasaki; Motokazu Ukioka, Shizuoka, both of Japan

[73] Assignee: Mitsubishi Denki Kabushiki Kaisha, Tokyo, Japan

[21] Appl. No.: 770,931

[22] Filed: Oct. 4, 1991

[30] Foreign Application Priority Data

Oct. 4, 1990 [JP] Japan ..... 2-267194
Oct. 5, 1990 [JP] Japan ..... 2-267990
Dec. 14, 1990 [JP] Japan ..... 2-402326

[51] Int. Cl.[5] ..... F04C 18/04; F04B 39/12

[52] U.S. Cl. ..... 418/55.1; 417/410 R; 417/902; 29/888.022

[58] Field of Search ..... 418/55.1, 55.6, 55.3, 418/55.4, 55.5; 417/410, 902; 29/888.022

[56] References Cited

U.S. PATENT DOCUMENTS 4,552,518 11/1985 Utter ..... 418/55.6
4,702,683 10/1987 Inaba et al. ..... 418/57
4,767,293 8/1988 Caillat et al. ..... 418/57
5,000,669 3/1991 Shimizu et al. ..... 418/55.6

FOREIGN PATENT DOCUMENTS 61-226587 10/1986 Japan ..... 418/55.6
62-150001 7/1987 Japan ..... 418/55.1
2-5780 1/1990 Japan ..... 418/55.1
2-49989 2/1990 Japan ..... 418/55.6
2-191878 7/1990 Japan .

*Primary Examiner*—John J. Vrablik
*Attorney, Agent, or Firm*—Oblon, Spivak, McClelland, Maier & Neustadt

[57] ABSTRACT

A scroll type compressor comprising: a frame which has the orbiting scroll put thereon, which has a peripheral portion formed with a flange, which has the fixed scroll fixed on the flange, which has a bearing at a central portion, and which has an outer peripheral surface formed with a stepped portion; a crankshaft which is rotatably supported at its upper portion by the frame bearing and which supports an electric motor rotor at a central portion; a subframe which has a central portion formed with a bearing for rotatably supporting the crankshaft at its lower end; a center shell which has an upper inner peripheral surface formed with a stepped portion engageable with the stepped portion in the frame, which has the frame shrinkage fitted thereto, shells which are connected to both ends of the center shell to form a hermetic housing; wherein the center shell has a lower inner peripheral surface formed with a stepped portion, the stepped portion in the upper inner peripheral surface and the stepped portion in the lower inner peripheral surface are formed to keep predetermined parallelism and coaxiality, and the subframe is fixed to the stepped portion in the lower inner peripheral surface.

1 Claim, 19 Drawing Sheets

SCROLL TYPE COMPRESSOR HAVING STEPPED ASSEMBLING PORTIONS ON THE CENTER SHELL

BACKGROUND OF THE INVENTION

1. Field of the Invention

The present invention relates to a scroll type compressor, and a method for preparing it, the compressor having the inside of a hermetic housing divided into a high pressure space and a low pressure space, and having a crankshaft supported in a way to sandwich an electric motor portion between both ends of the crankshaft.

2. Discussion of Background

In FIG. 14, there is shown a longitudinal sectional view of a conventional scroll type compressor. In FIG. 15, there is shown a longitudinal sectional view of parts shrinkage fitted in the compressor of FIG. 14. Reference numeral 1 designates a fixed scroll which has a base plate 1*a* provided with a scroll wrap 1*b* thereon. Reference numeral 2 designates an orbiting scroll which has a base plate 2*a* provided with a scroll wrap 2*b* thereon. The scroll wraps 1*b* and 2*b* are reverse to each other in the direction in which the scroll wraps are wound, and are combined to form a compression chamber 4. Reference numeral 3 designates a discharge port which is formed in the base plate 1*a* to communicate with the compression chamber 4. Reference numeral 7 designates a frame which is formed with a flange 7*b*. The base plate 1*a* is fixedly supported on the upper end surface of the flange. The flange 7*b* has an outer peripheral surface formed with a stepped portion 7*c*. The flange 7*b* has an inner peripheral surface formed with a concentric assemblage jig mounting surface 7*d*, the concentric assemblage jig mounting surface being concentric with a bearing 13 which is located at a central portion of the frame 7. Reference numeral 6 designates a crankshaft which has an intermediate portion provided with an electric motor rotor 8, and which is rotatably supported by the bearing 13. Reference numeral 23 designates a center shell which has an intermediate portion provided with a glass terminal 42, and which supports an electric motor stator 9 on an inner peripheral surface. The center shell has an upper inner peripheral surface formed with a stepped portion 23*a*, which is engaged with the stepped portion 7*c*. To the center shell 23 is fixed the frame 7 at an upper end side of the stepped portions 7*c* and 23*a* by shrinkage fit. Reference numeral 27 designates a subframe which is fixed to an inner peripheral surface of a lower end of the center shell 23 by welding, and which has a central portion formed with a bearing 39 for supporting the crankshaft 9 at its lower end. The bearing 39 has a lower portion formed with a concentric assemblage jig mounting surface 27*b* concentric therewith, a pumping element 43 being housed on the concentric assemblage jig mounting surface 27*b*. Reference numeral 20 designates a discharge chamber which is mounted to the upper end of the center shell 23 to close it. Reference numeral 40 designates a low pressure space which is formed under the frame 7. Reference numeral 41 designates a high pressure space which formed in the discharge chamber 20. The center shell 23 have the lower end closed by a lower shell 10, and an oil stored therein.

In operation, the crankshaft 6 which is driven by an electric motor comprising the electric motor stator 9 and the electric rotor 8 rotates while being supported by the bearings 13 and 39. The base plate 2*a* of the oribiting scroll 2 is eccentrically connected to the upper end of the crankshaft 6, and is supported on the frame 7 so as to be capable of carrying out orbiting movement. The rotation of the crankshaft 6 gives orbiting movement to the orbiting scroll 2 to form the compression chamber 4 between the fixed scroll 1 and the orbiting scroll 2. A low pressure refrigerant gas which has been introduced into the low pressure space 40 from outside is inspired into the compression chamber 4 by the action of compression between both scrolls 1 and 2, and is compressed into a high pressure refrigerant gas. The high pressure refrigerant gas is discharged from the discharge port 3 into the high pressure space 41, and leaves outside though a discharge pipe 5 which is mounted to the discharge chamber 20. As shown in FIG. 15, the stepped portion 7*c* in the frame 7 is supported by the stepped portion 23*a* in the center shell 23. Thrust which is caused on the frame 7 due to a difference between the pressure in the low pressure space 40 and that in the high pressure space 41 is received by the center shell 23. Such an arrangement can prevent the frame 7 from axially shifting in the center shell 23. The outer peripheral surface of the flange 7*b* and the inner peripheral surface of the center shell 23 are fixed together at the upper end side of the stepped portions 7*c* and 23*a* by shrinkage fit to hermetically separate the high pressure space 41 and the low pressure space 40.

In order to assemble the frame 7 and the subframe 27, it is required that misalignment and inclination of the bearing 39 of the subframe 27 with respect to the bearing 13 of the frame 7 fall in predetermined precision ranges. Now, a method for assembling the frame 7 and the subframe 27 will be explained, referring to FIGS. 16 and 17. In FIG. 16, the frame 7 and the electric motor stator 9 have been previously fixed to the center shell 23 by shrinkage fit, and the electric motor rotor 8 is inserted in the center shell 23 in such a state that the end of the center shell 23 adjacent to the frame 7 faces downward. The center shell 23 with the frame 7 and the electric motor stator 9 fixed thereto and the electric motor rotor 8 inserted thereinto is placed on a table 45*a* to put the concentric assemblage jig mounting surface 7*d* of the frame 7 into engagement with a concentric assemblage jig 44*a*, and to position a fixed scroll mounting surface 7*e* of the frame 7 on a top surface of the table 45*a*. On the other hand, the subframe 27 is mounted onto a bottom surface of a table 45*b* to put the concentric assemblage jig mounting surface 27*b* of the subframe 27 into engagement with a concentric assemblage jig 44*b*, thereby positioning a reference surface 27*c* of the subframe 27 onto the bottom surface of the table 45*b*. The table 45*b* and the concentric assemblage jig 44*b* are vertically slided from such conditions to insert the subframe 27 into the center shell 23 until the subframe 27 is set at a predetermined height as shown in FIG. 17. During this process, the subframe 27 should not get in touch with the inner peripheral surface of the center shell 23. Finally, the subframe 27 is fixed to the center shell 23 by means of arc spot welding. In order that the misalignment and the inclination of the bearing 39 with respect to the bearing 13 fall in the predetermined precision ranges, coaxiality of the concentric assemblage jig mounting surface 7*d* with respect to the bearing 13, perpendicularity of the fixed scroll mounting surface 7*e* with respect to the bearing 13, coaxiality of the concentric assemblage jig mounting surface 27*b* with respect to the bearing 39, perpendicularity of the reference surface 27*c* with respect to the bearing 39, coaxiality of the concentric assemblage jig 44*b* with respect to the concentric assemblage jig 44*a*, and parallelism of the table 45*b* with respect to the table 45*a* are required to fall in predetermined precision ranges as a prerequisite. In addition, the arc spot welding should have no effect on a relative position or posture of the subframe 27 with respect to the frame 7.

The structure of the conventional scroll type compressor, which has been described in detail, does not ensure coaxiality between an outer peripheral surface of the subframe 27 and the inner peripheral surface of the center shell 23. In order to prevent the subframe 27 from getting in touch with the center shell 23 during inserting the subframe 27 into the center shell 23, a remarkably great clearance is required between the subframe 27 and the center shell 23. The sizes of the clearance significantly vary, depending on the positions of the arc spot welding. As a result, when the subframe 27 is fixed to the center shell 23, there are variations in strain due to arc spot welding, depending on the positions of the arc spot welding. This creates a problem in that the relative position and the posture of the bearing 39 with respect to the bearing 13 are changed, and the misalignment and the inclination go out of the predetermined precision ranges, lowering a fabrication yield.

It is a first object of the present invention to solve this problem, and to provide a scroll type compressor capable of realizing a high yield without being adversely affected by a change in a relative position and a posture of a subframe bearing with respect to a frame bearing due to arc spot welding, and a method for preparing such a scroll type compressor.

By the way, there has been known a scroll type compressor wherein a bearing which supports one end of the main shaft for driving an orbiting scroll is supported by a subframe, and the subframe is fixed to a side wall of a hermetic shell by means of spot welding.

Referring now to FIG. 18, there is shown a cross sectional view showing the structure of such a conventional scroll type compressor.

In FIG. 18, reference numeral 101 designates a fixed scroll which is constituted by a base plate 101*a* and a spiral wrap 101*b* projecting from it. Reference numeral 102 designates an orbiting scroll which comprises a base plate 102*a* and a spiral wrap 102*b* projecting from it. Reference numeral 103 designates a frame which has one side provided with a flange 103*a*, and which has the other side provided with a bearing 103*c*. The flange 103*a* has the fixed plate 101*a* fixedly supported at a top end surface, and the flange 103*a* defines a recessed portion 103*b* at a central portion, where the orbiting scroll 102 is put to carry out an orbital movement. The bearing 103*c* is formed to project in the axial direction for supporting one end of a main shaft, which is described later on.

Reference numeral 104 designates a hermetic shell which is constituted by a center shell 104*a* and dish-shaped end shells 104*b*, the center shell 104*a* being formed in a cylindrical shape and having the flange 103*a* fixed to an upper inner peripheral surface thereon by means of shrinkage fit, and the dish-shaped end shells 104*b* being fixed to the center shell 104 by welding the end shells to both ends of the center shell 104 at their circumferences in a continuous sequence to close the open ends of the center shell. Reference numeral 105 designates a compression chamber which is defined between both spiral wraps 101*b* and 102*b*. Reference numeral 106 designates a high pressure space which is formed between the base plate 101*a* and the end shell 104*b*. Reference numeral 107 designates a discharge port which is formed through a central portion of the base plate 101*a* to communicate between the compression chamber 105 and the high pressure space 106.

Reference numeral 108 designates a subframe which has a central portion provided with a bearing 108*a* to companion to the bearing 103*c* of the frame 103, and which has an outer side surface provided with a plurality of radial ribs 108*b*, as shown in FIG. 19 depicting the section taken along the line 19—19 of FIG. 18. Each rib 108*b* has an outer side surface fixed to a lower inner peripheral wall of the center shell 104*a* by means of spot welding. Reference numeral 109 designates the main shaft which has the one end supported by the bearing 103*c* of the frame 103 and the other end supported by the bearing 108*a* of the subframe 108, and which is rotatably connected to the orbiting scroll 102 at the one end side. In a central portion of the main shaft, a bore 109*a* is formed therethrough so that a lubricating oil which is supplied through a pumping device 110 arranged in the subframe 108 flows through the bore 109*a*.

Reference numeral 111 designates a low pressure space which is defined under the frame 103. Reference numeral 112 designates an electric motor which is arranged in the low pressure space 111 to rotate the main shaft 109, and which is constituted by an electric motor rotor fixed to the main shaft 109 by e.g. press fit, and an electric motor stator fixed to an inner side wall surface of the center shell 104*a*. Reference numeral 113 designates a glass terminal which is mounted in a side wall of the center shell 104*a* to feed power to the electric motor 112.

Now, how to fix the subframe 108 and the end shell 104*b* to the center shell 104 by welding in more detail. As shown in FIG. 19, firstly, the outer side surfaces of the respective ribs 108*b* of the subframe 108 are inserted to a predetermined position along the inner peripheral wall of the center shell 104*a*, and the ribs 108*b* are fixed to the center shell 104*a* by arc spot welding. Welding points by the arc spot welding are indicated by reference numerals 114*a*, 114*b* and 114*c*. When the subframe 108 is fixed, the precision of the respective parts is controlled so that the subframe 108 is coaxial with the frame 103 on the order of a few μm–a few tens μm.

Next, the end shell 104*b* is press fitted into the center shell 104*a* in a light manner, and then a single welding torch is usually used to seal the end shell 104*b* to the center shell 104*a* around its circumference by continuous arc welding while moving the torch or rotating the center shell 104*a* and the end shell 104*b*. The starting point of the arc welding is indicated by reference numeral 115*a*.

The conventional scroll type compressor which is constructed as stated above carries out the following operations as generally well known. The main shaft 109 which is driven by the electric motor 112 rotates, being supported by the bearing 103*c* of the frame 103 and the bearing 108*a* of the subframe 108, thereby causing the orbiting scroll 102 to carry out an orbital movement. Such an orbital movement allows a low pressure refrigerant gas in the low pressure space 111 to be inspired into the compression chamber 105 defined by the wraps 101*b* and 102*b* of the fixed scroll 101 and the orbiting scroll 102. After the refrigerant gas is compressed in the compression chamber 105 to become a high pressure refrigerant gas, it is discharged into the high pressure space 106 through the discharge port 107, and leaves outside the hermetic shell 104.

Since the conventional scroll type compressor is constituted as stated earlier, when the end shell 104*b* is connected to the center shell 104*a* by arc welding, the point where a melted metal starts solidifing is located near to the welding starting point 115*a*. As a result, the end shell 104*b* is drawn toward the welding starting point 115*a* of the center shell 104*a*. Because the end shell 104*b* can shift freely in a radial direction in the center shell 104*a* at that stage, a gap can be formed between the end shell 104*b* and the center shell 104*a* at the location remote from the welding starting point 115*a* as shown in FIG. 20, thereby preventing welding from causing internal stress.

After that, the melted metal gradually solidifies along the route where the welding has progressed. As a result, portions of the center shell 104*a* are drawn toward the end shell 104*b*, and the center shell 104*a* is deformed in a way to collapse inwardly. How much the center shell 104*a* is deformed inwardly is roughly proportional to the size of the gap between the end shell 104*b* and the center shell 104*a*. It means that the deformation at the side of the center shell 104*a* remote from the welding starting point 115*a*, i.e. the deformation in the direction of a welding point 114*a* of the arc spot welding is the greatest. Since the subframe 104*b* also slightly shifts toward the welding starting point 115*a*, in addition to such deformation as indicated by an arrow in FIG. 21, coaxiality of the subframe 104*b* with respect to the frame 103 deteriorates. It creates a problem in that if this deterioration exceeds an acceptable limit, the rotation of the main shaft 109 supported by the bearings 103*c* and 108*a* becomes worse to damage performance.

It is a second object of the present invention to solve this problem, and to provide a scroll type compressor capable of make the rotation of a main shaft smooth and of preventing performance from being damaged without deteriorating coaxiality of a subframe with respect to a frame by subjecting an end shell to welding.

SUMMARY OF THE INVENTION

In order to attain the first object of the present invention, according to a first aspect of the present invention, there is provided a scroll type compressor comprising a fixed scroll and an orbiting scroll which have their base plates provided with scroll wraps thereon, and which have the scroll wraps combined to form a compression chamber therebetween, the scroll wraps being reversed to each other in the direction in which the scroll wraps are wound; a frame which has the orbiting scroll put thereon so as to allow the orbiting scroll to carry out orbiting movement, which has a peripheral portion formed with a flange, which has the fixed scroll fixed on the flange, which has a bearing at a central portion, and which has an outer peripheral surface formed with a stepped portion; a crankshaft which is rotatably supported at its upper portion by the frame bearing to give orbiting movement to the orbiting scroll connected to the upper end of the crankshaft, and which supports an electric motor rotor at a central portion; a subframe which has a central portion formed with a bearing for rotatably supporting the crankshaft at its lower end; a center shell which has an upper inner peripheral surface formed with a stepped portion engageable with the stepped portion in the frame, which has the frame shrinkage fitted thereto, which has a glass terminal below the stepped portion, which has an electric motor stator fixed below the glass terminal, and which has the subframe fixed below the electric motor stator; shells which are connected to both ends of the center shell to form a hermetic housing; and the hermetic housing divided into a high pressure space and a low pressure space at a boundary which is formed by the shrinkage fitted portions of the center shell and the frame; wherein the center shell has a lower inner peripheral surface formed with a stepped portion, the stepped portion in the upper inner peripheral surface and the stepped portion in the lower inner peripheral surface are formed to keep predetermined parallelism and coaxiality, and the subframe is fixed to the stepped portion in the lower inner peripheral surface.

According to a second aspect of the present invention, there is provided a method for preparing a scroll type compressor which comprises a fixed scroll and an orbiting scroll which have their base plates provided with scroll wraps thereon, and which have the scroll wraps combined to form a compression chamber therebetween, the scroll wraps being reverse to each other in the direction in which the scroll wraps are wound; a frame which has the orbiting scroll put thereon so as to allow the orbiting scroll to carry out orbiting movement, which has a peripheral portion formed with a flange, which has the fixed scroll fixed on the flange, which has a bearing at a central portion, and which has an outer peripheral surface formed with a stepped portion; a crankshaft which is rotatably supported at its upper portion by the frame bearing to give orbiting movement to the orbiting scroll connected to the upper end of the crankshaft, and which supports an electric motor rotor at a central portion; a subframe which has a central portion formed with a bearing for rotatably supporting the crankshaft at its lower end; a center shell which has an upper inner peripheral surface formed with a stepped portion engageable with the stepped portion in the frame, which has the frame shrinkage fitted thereto, which has a glass terminal below the stepped portion, which has an electric motor stator fixed below the glass terminal, and which has the subframe fixed below the electric motor stator; shells which are connected to both ends of the center shell to form a hermetic housing; and the hermetic housing divided into a high pressure space and a low pressure space at a boundary which is formed by the shrinkage fitted portions of the center shell and the frame; comprising: fixing the glass terminal and the electric motor stator to the center shell before having formed the stepped portion in the upper inner peripheral surface of the center shell; forming the stepped portion in the upper inner peripheral surface and a stepped portion of a lower inner peripheral surface of the center shell by machining, using the inner diameter of the electric motor stator as datum, after fixing of the glass terminal and the electric motor stator; and fixing the subframe to the stepped portion of the lower inner peripheral surface.

According to a third aspect of the present invention, there is provided a method for preparing a scroll type compressor which comprises a fixed scroll and an orbiting scroll which have their base plates provided with scroll wraps thereon, and which have the scroll wraps combined to form a compression chamber therebetween, the scroll wraps being reverse to each other in the direction in which the scroll wraps are wound; a frame which has the orbiting scroll put thereon so as to allow the orbiting scroll to carry out orbiting movement, which has a peripheral portion formed with a flange, which has the fixed scroll fixed on the flange, which has a bearing at a central portion, and which has an outer peripheral surface formed with a stepped portion; a crankshaft which is rotatably supported at its upper portion by the frame bearing to give orbiting movement to the orbiting scroll connected to the upper end of the crankshaft, and which supports an electric motor rotor at a central portion; a subframe which has a central portion formed with a bearing for rotatably supporting the crankshaft at its lower end; a center shell which has an upper inner peripheral surface formed with a stepped portion engageable with the stepped portion in the frame, which has the frame shrinkage fitted thereto, which has a glass terminal below the stepped portion, which has an electric motor stator fixed below the glass terminal, and which has the subframe fixed below the electric motor stator; shells which are connected to both ends of the center shell to form a hermetic housing; and the hermetic housing divided into a high pressure space and a low pressure space at a boundary which is formed by the shrinkage fitted portions of the center shell and the frame; comprising: preparing the subframe in such a manner that it is divided into a subframe holder to be fixed to the center shell and a subframe bearing part having the bearing, the subframe holder having screwed holes formed therein, and the subframe bearing part having holes formed therein; preliminarily assembling the subframe bearing part onto the subframe holder by use of bolts inserted into the screwed holes and the holes in the subframe bearing part so that the bearing of the subframe bearing part is arranged to be coaxial with the outer diameter of the subframe, and the screwed holes are located in alignment with the holes which are formed in the subframe bearing part so as to correspond to the screwed holes; and then fixing the subframe holder to the center shell.

According to a fourth aspect of the present invention, there is provided a method for preparing a scroll type compressor which comprises a fixed scroll and an orbiting scroll which have their base plates provided with scroll wraps thereon, and which have the scroll wraps combined to form a compression chamber therebetween, the scroll wraps being reverse to each other in the direction in which the scroll wraps are wound; a frame which has the orbiting scroll put thereon so as to allow the orbiting scroll to carry out orbiting movement, which has a peripheral portion formed with a flange, which has the fixed scroll fixed on the flange, which has a bearing at a central portion, and which has an outer peripheral surface formed with a stepped portion; a crankshaft which is rotatably supported at its upper portion by the frame bearing to give orbiting movement to the orbiting scroll connected to the upper end of the crankshaft, and which supports an electric motor rotor at a central portion; a subframe which has a central portion formed with a bearing for rotatably supporting the crankshaft at its lower end; a center shell which has an upper inner peripheral surface formed with a stepped portion engageable with the stepped portion in the frame, which has the frame shrinkage fitted thereto, which has a glass terminal below the stepped portion, which has an electric motor stator fixed below the glass terminal, and which has the subframe fixed below the electric motor stator; shells which are connected to both ends of the center shell to form a hermetic housing; and the hermetic housing divided into a high pressure space and a low pressure space at a boundary which is formed by the shrinkage fitted portions of the center shell and frame; comprising: preparing the subframe in such a manner that it is divided into a subframe holder to be fixed to the center shell and a subframe bearing part having the bearing, measuring an inclining angle and an inclining direction of the bearing of the subframe bearing part with respect to the frame bearing; determining a two dimensional acceptable range for misalignment of the subframe bearing part with respect to the frame bearing, depending on values indicative of the inclining angle and the inclining direction; and assembling the subframe bearing part to the subframe holder by use of bolts so that the misalignment comes into the range.

In order to attain the second object of the present invention, the present invention provides a scroll type compressor comprising a hermetic shell which is constituted by a cylindrical center shell, and dish-shaped end shells closing both ends of the center shell and fixed to the center shell by continuously welding the end shells to the center shell at their circumference; a fixed scroll and an orbiting scroll which are housed in the hermetic shell, and which gradually compresses an inspired refrigerant gas in a compression chamber formed by combining scroll wraps, and discharges the compressed gas; a main shaft rotated by an electric motor to drive the orbiting scroll; a frame having a peripheral portion fixed to the center shell, and supporting the main shaft at its one end; and a subframe having a peripheral portion fixed to the center shell by spot welding, and supporting the main shaft at its other end; wherein the welding starting point of the continuous welding for fixing the end shells to the center shell is arranged to be in the same direction on the circumference of the center shell as one of the welding points of the spot welding for fixing the subframe to the center shell.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
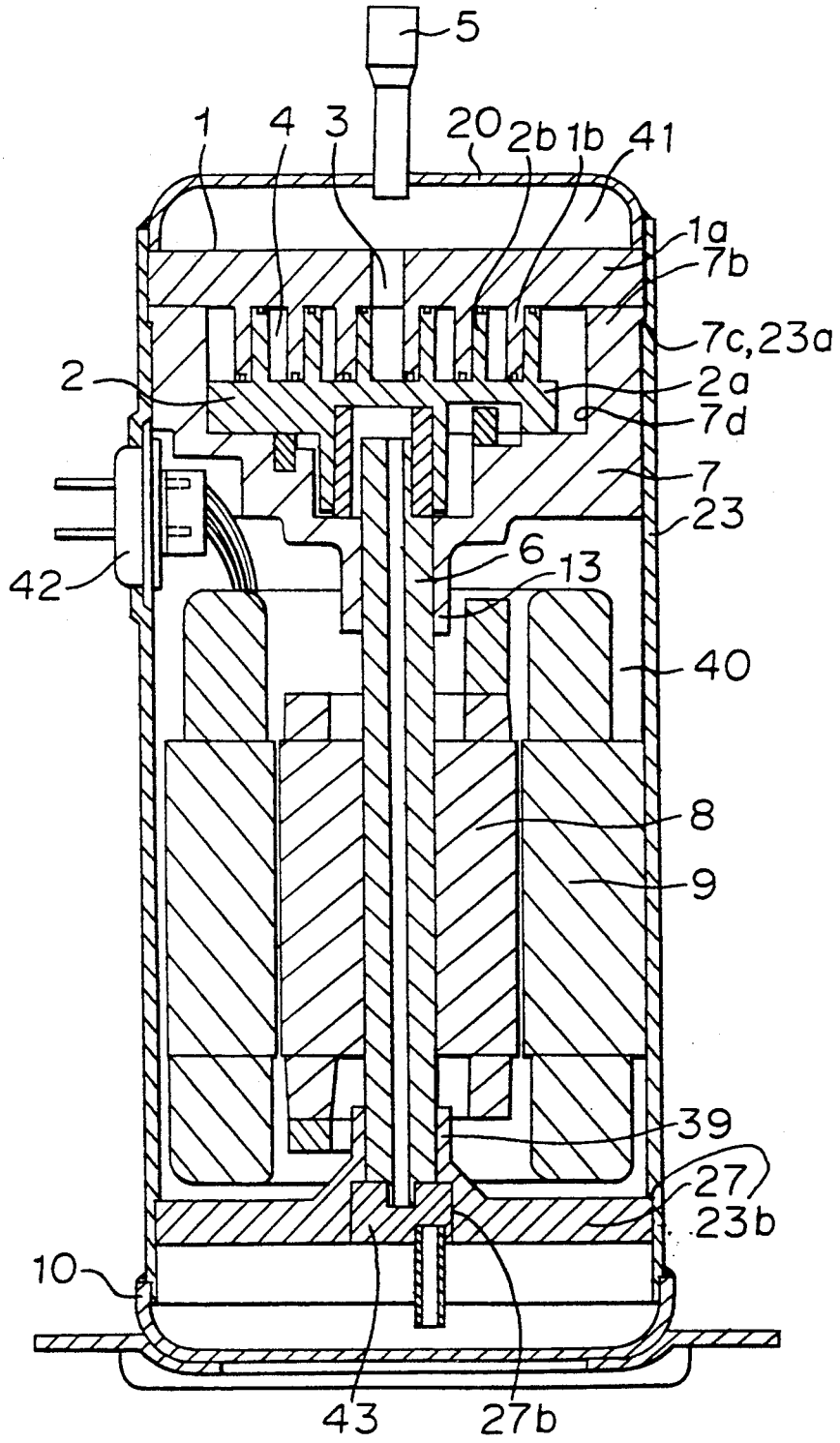
FIG. 1 is a longitudinal sectional view of the scroll type compressor according to a first embodiment of the present invention.

Referring now to the drawings, wherein like reference numerals designate identical or corresponding parts throughout the several views, and more particularly to FIG. 1 thereof, there is shown a longitudinal sectional view of the scroll type compressor according to a first embodiment of the present invention. Parts common to the conventional scroll type compressor are indicated by the same reference numerals as the parts of the conventional scroll type compressor, and explanation of those parts will be omitted for the sake of simplicity. The center shell 23 has a lower inner peripheral surface formed with a stepped portion 23*b*, to which the subframe 267 is fixed by means of welding. For machining the stepped portions 23*a* and 23*b*, glass terminal 42 and the electric motor stator 9 are previously fixed to the center shell 23, and then a lathe is used to carry out requisite machining, using the inner diameter of the electric motor stator 9 as datum. Such machining can ensure coaxiality and parallelism of the stepped portion 23*a* and 23*b* with respect to the inner diameter of the electric motor stator 9 at high precision.

Figure 2:
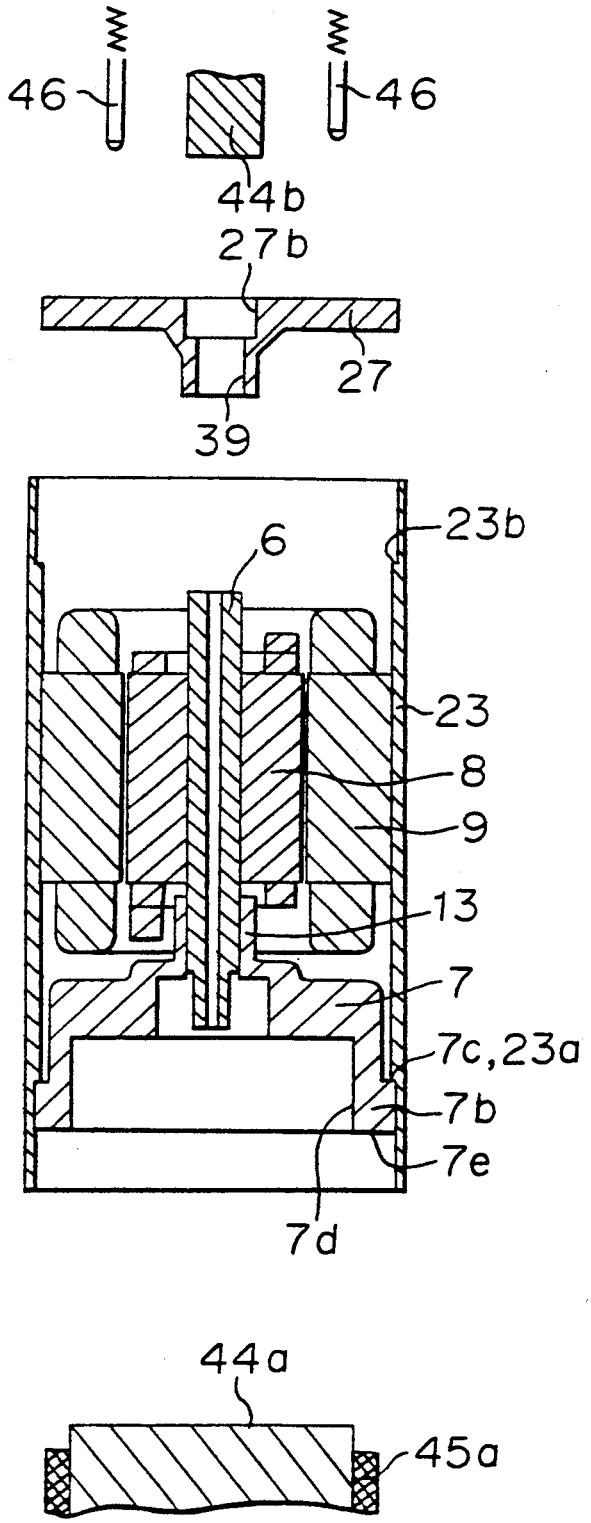
FIGS. 2 and 3 are longitudinal sectional views showing how to assemble the scroll type compressor of the first embodiment.
Figure 3:
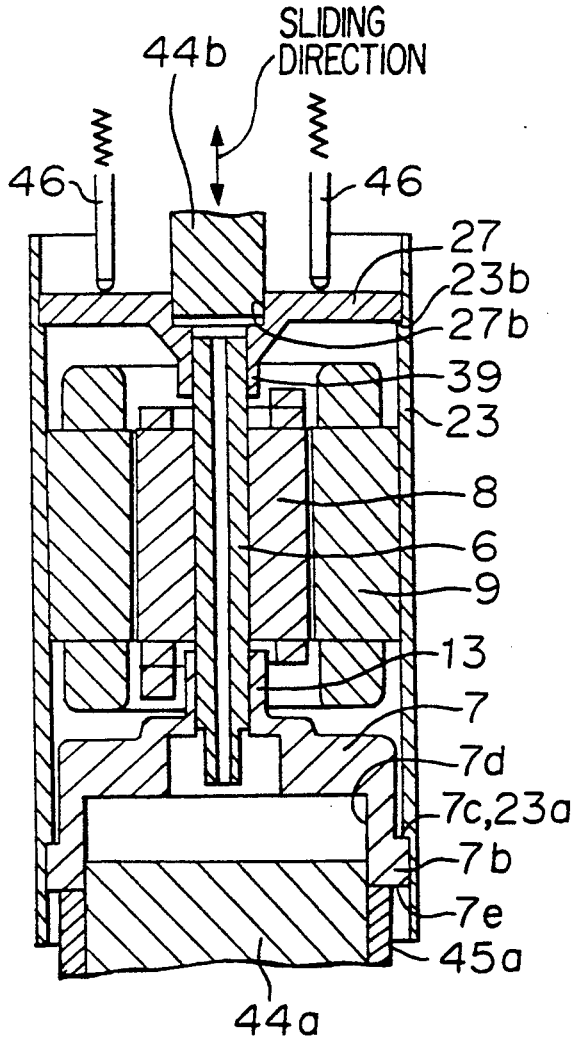

The compression operation in the scroll type compressor of the first embodiment is similar to the conventional scroll type compressor. Now, how to assemble the frame 7 and the subframe 27 will be explained, referring to FIGS. 2 and 3. In FIG. 2, the electric motor stator 9 and the frame 7 have been previously shrinkage fitted into the center shell 23, and the electric motor rotor 8 is inserted in such a state that the end of the center shell 23 adjacent to the frame 7 faces downward. The center shell 23 with the electric motor stator 9, the frame 7 and the electric motor rotor in it is placed onto the table 45*a* to put the concentric assemblage jig 44*a* into engagement with the concentric assemblage jig mounting surface 7*d* of the frame 7, and to put the fixed scroll mounting surface 7*e* of the frame 7 onto the table 45*a*. On the other hand, the concentric assemblage jig 44*b* is put into engagement with the concentric assemblage jig mounting surface 27*b* of the subframe 27. From such conditions, the concentric assemblage jig 44*b* is vertically slided to insert the subframe 27 into the center shell 23, and the subframe 27 is pressed against the stepped portion 23*b* by press pins 46. The subframe 27 is fixed to the center shell 23 by means of arc spot welding under these conditions. On the assumption that coaxiality of the concentric assemblage jig mounting surface 7*d* with respect to the bearing 13, perpendicularity of the stepped portion 7*c* and the fixed scroll mounting surface 7*e* with respect to the bearing 13, coaxiality of the outer peripheral surface of the subframe 27 and the concentric assemblage jig mounting surface 27*b* with respect to the bearing 39, perpendicularity of the outer peripheral undersurface (at the side of the stepped portion 23*b*) of the subframe 27 with respect to the bearing 39, and coaxiality of the concentric assemblage jig 44*b* with respect to the concentric assemblage jig 44*a* fall in predetermined precisions, the clearance between the outer peripheral surface of the subframe 27 and the inner peripheral surface of the stepped portion 23*b* in the center shell 23 is constant, and distortion due to the arc spot welding is equalized. As a result, the arc spot welding has no adverse influence on the relative position of the bearing 39 with respect to the bearing 13. In addition, the arc spot welding has no adverse influence on the posture of the bearing 39 with respect to the bearing 13 because the subframe 27 is supported by the stepped portion 23*b* of the center shell. Further, the stepped portions 23*a* and 23*b* of the center shell 23 are machined, using the inner diameter of the electric motor stator 9 as datum, thereby allowing coaxiality between the electric motor stator 9 and the electric motor rotor 8 to be obtained at a high precision, and electric motor efficiency to be improved.

Although the first embodiment has been explained on the case wherein the inner peripheral surface of the center shell 23 is connected to the outer peripheral surface of the subframe 27 by means of clearance fit, interference fit can be adopted. Although the interference fit requires that the subframe 27 be shrinkage fitted to the center shell 23 to insert the subframe 27 into the center shell 23, coaxiality of the concentric assemblage jig mounting surface 7*d* with respect to the bearing 13, perpendicularity of the fixed scroll mounting surface 7*e* with respect to the bearing 13, coaxiality of the concentric assemblage jig mounting surface 27*b* with respect to the bearing 39, and coaxiality of the concentric assemblage jig 44*b* with respect to the concentric assemblage jig 44*a* may be lower than the first embodiment in terms of required precisions. The concentric assemblage jig 44*b* should be passively movable in the horizontal direction.

In accordance with the first embodiment, the subframe is pressed against the stepped portion of the center shell to be supported, thereby preventing arc spot welding from having adverse influence on the relative posture of the subframe bearing with respect to the frame bearing. In addition, when coaxiality between the bearing and the outer peripheral surface of the subframe falls into predetermined precision, coaxiality between the outer peripheral surface of the subframe and the inner peripheral surface of the lower stepped portion of the center shell can be ensured. This allows the clearance between the outer peripheral surface of the subframe and the inner peripheral surface of the lower stepped portion to become smaller, and the size of the clearance to be prevented from involving variations, depending on the positions of the arc spot welding. As a result, variations in distortion due to the arc spot welding can be eliminated, and consequently a change in the relative position of the subframe bearing with respect to the frame bearing can be prevented.

Further, in accordance with the first embodiment, the glass terminal and the electric motor stator can be fixed to the center shell, and then the respective inner stepped portions can be formed by machining, using the inner diameter of the electric motor stator as datum, thereby ensuring coaxiality and parallelism of the respective inner stepped portions.

Figure 4:
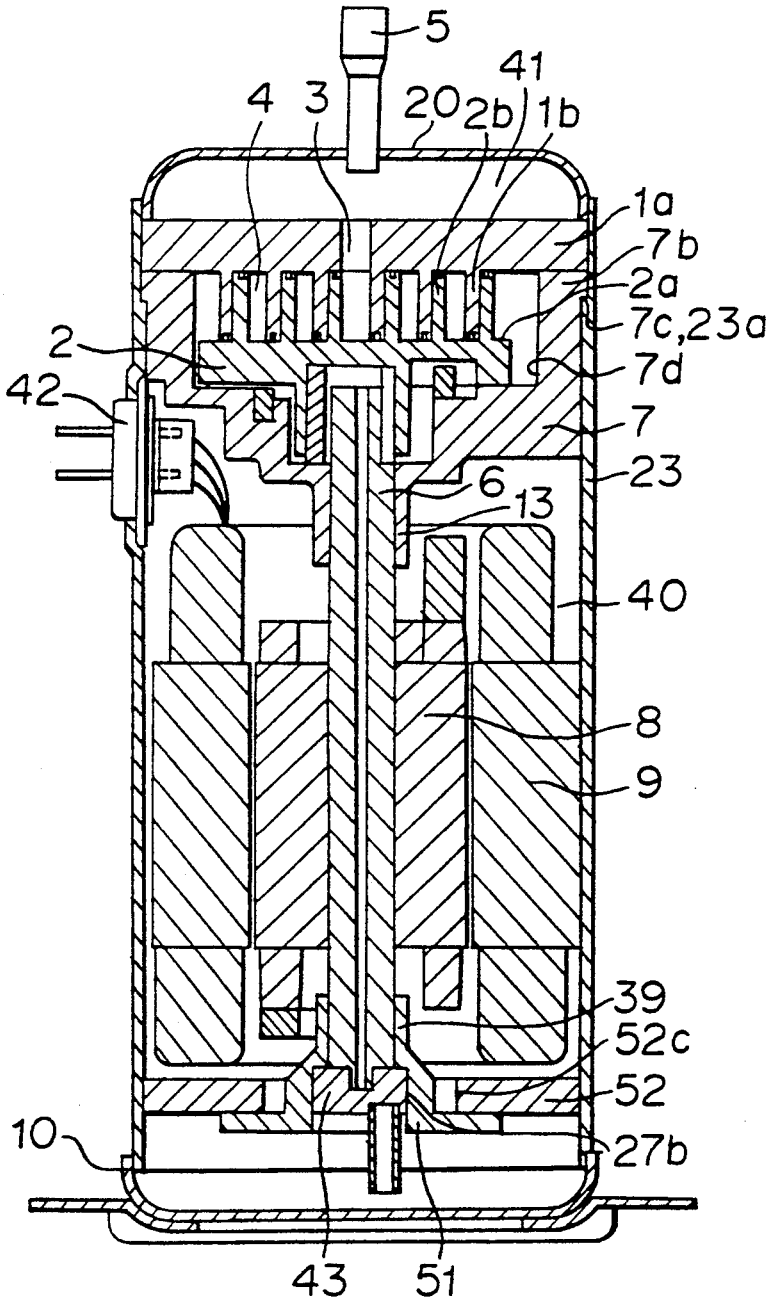
FIG. 4 is a longitudinal sectional view of the scroll type compressor according to a second embodiment of the present invention.

Referring now to FIG. 4, there is shown a longitudinal sectional view of the scroll type compressor according to a second embodiment. Parts common to the conventional scroll type compressor are indicated by the same reference numeral as the parts of the conventional scroll type compressor, and explanation on those parts will be omitted for the sake of simplicity. Reference numeral 52 designates a subframe holder which is welded to a lower inner peripheral surface of the center shell 23. Reference numeral 51 designates a subframe bearing part which is mounted to the subframe holder 52 by bolts (not shown), and which has a central portion formed with the bearing 39 for supporting a lower end of the crank shaft 6. The bearing part 51 and the holder 52 constitute the subframe. At a lower portion of the bearing 39 of the bearing part 51 is formed a concentric assemblage jig mounting surface 27*b* which is coaxial with the bearing 39. The pumping element 43 is housed in the concentric assemblage jig mounting surface 27*b*.

Figure 5:
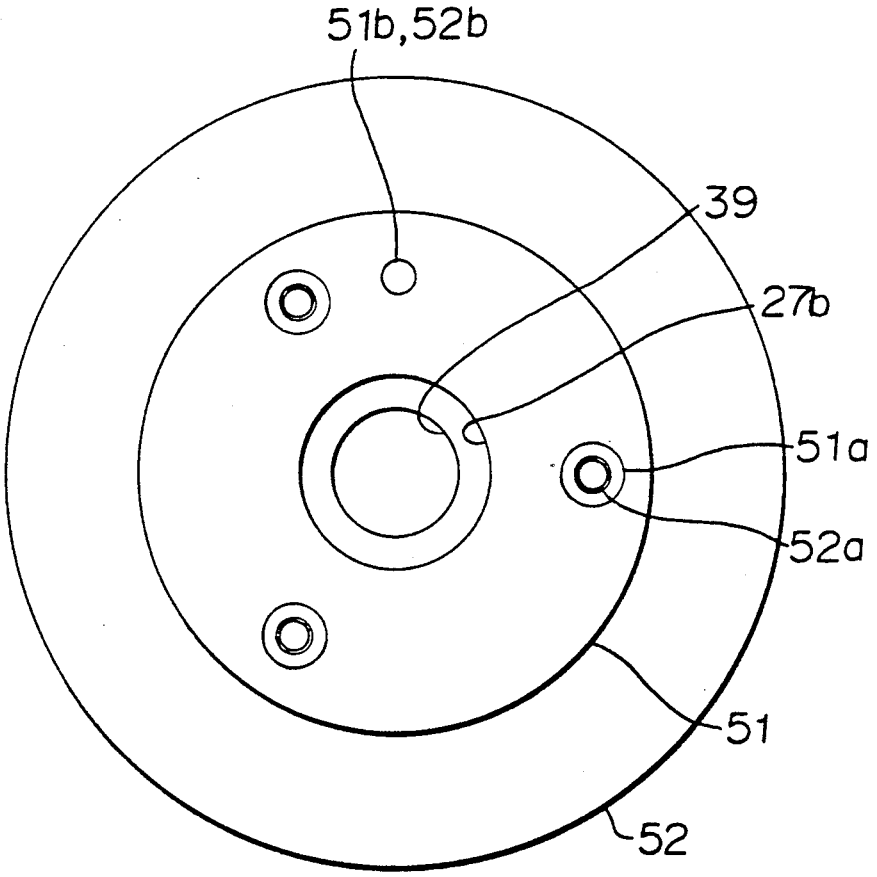
FIG. 5 is a bottom view of the subframe according to the second embodiment.
Figure 6:
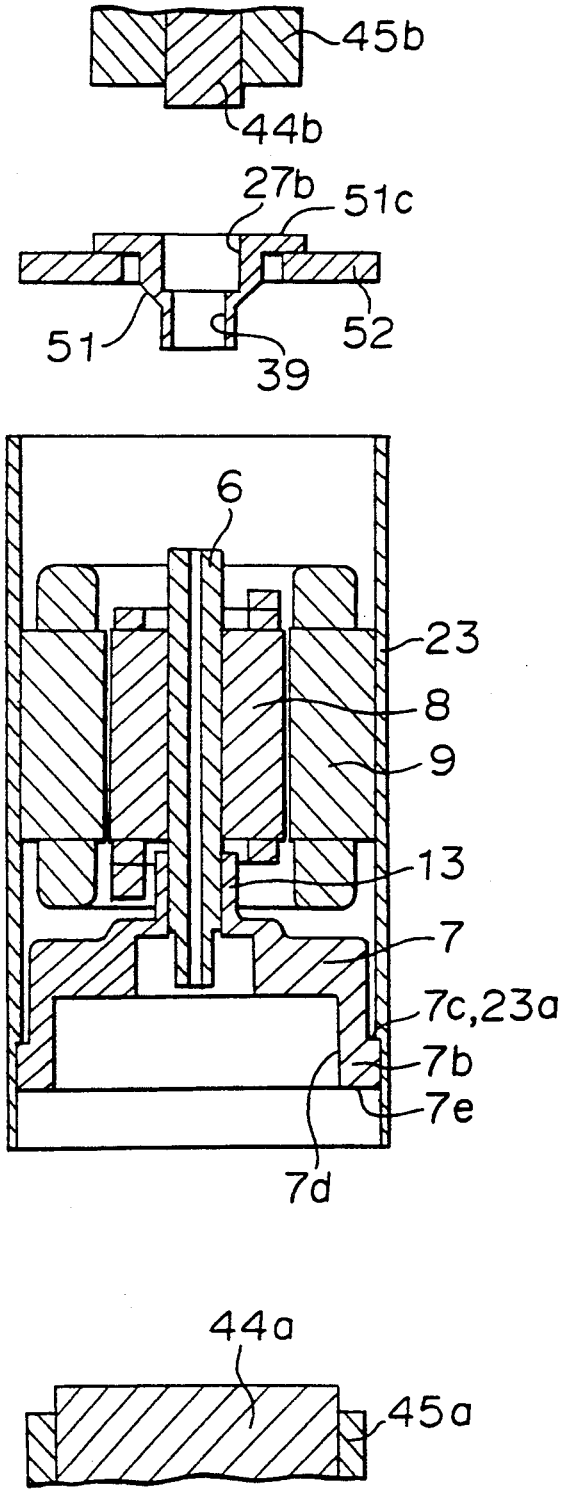
FIGS. 6 and 7 are longitudinal sectional views showing how to assemble the scroll type compressor according to the second embodiment.
Figure 7:
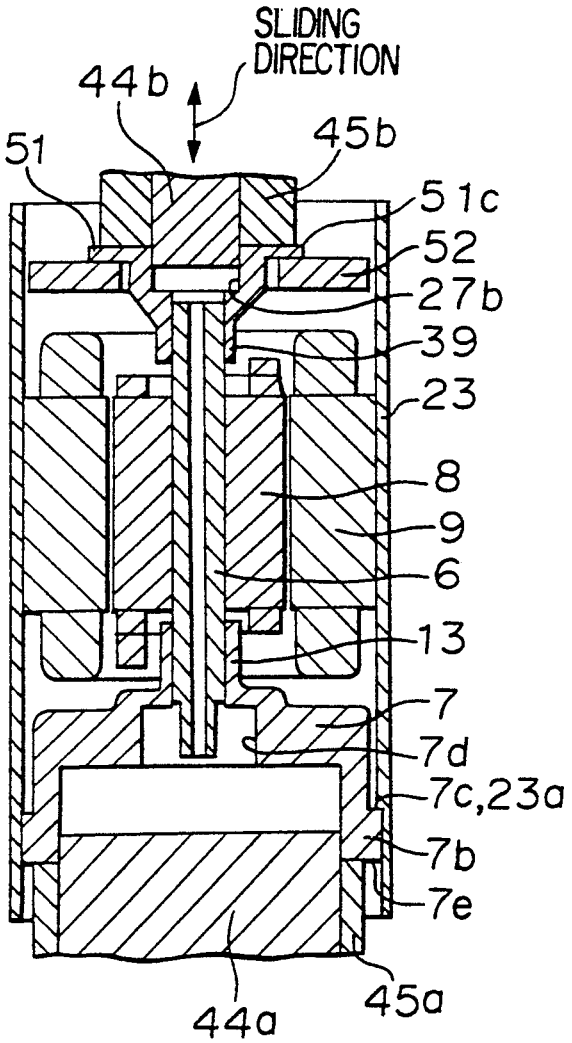
Figure 8:
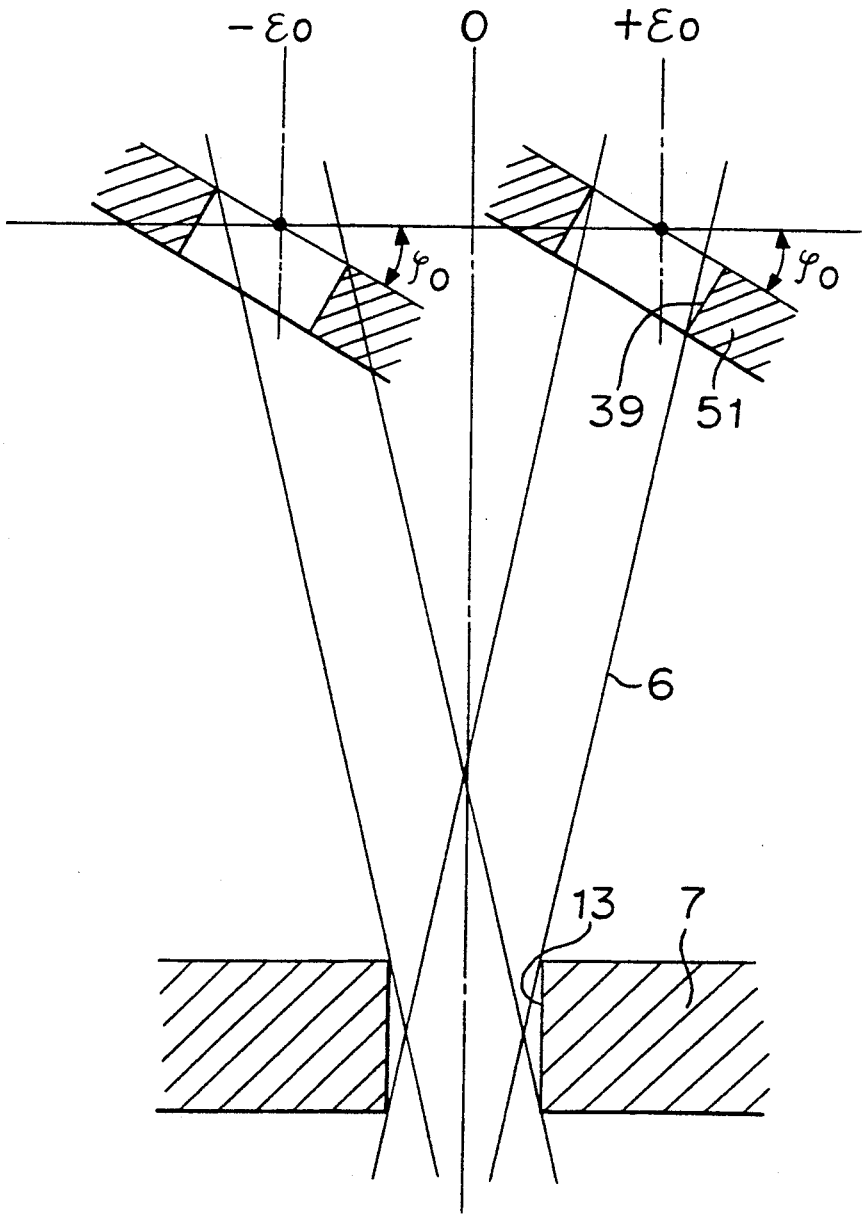
FIG. 8 is a schematic view showing relationships between the misalignment and the inclination of the subframe bearing according to the second embodiment.
Figure 9:
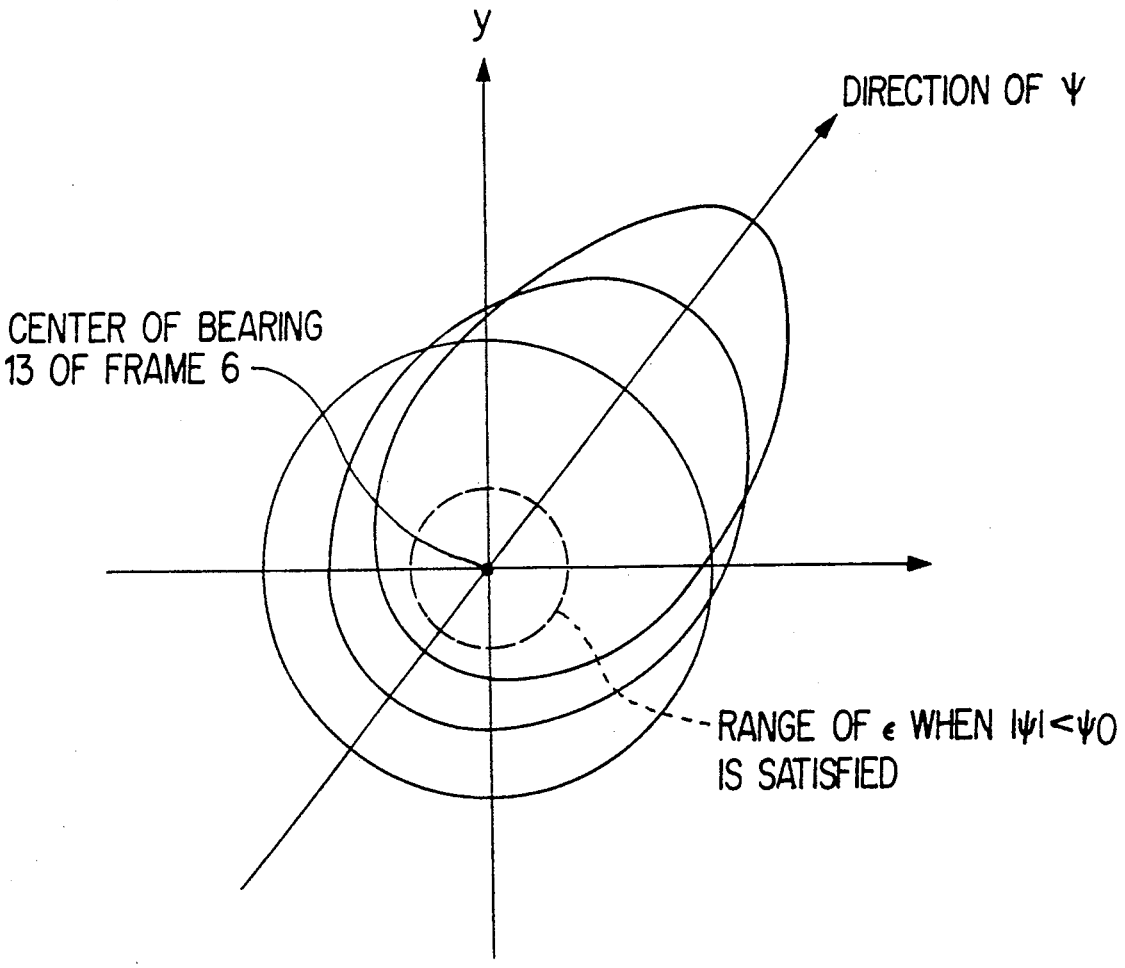
FIG. 9 is a schematic view showing an acceptable range for misalignment which is determined depending on the inclination of the subframe bearing.
Figure 10:
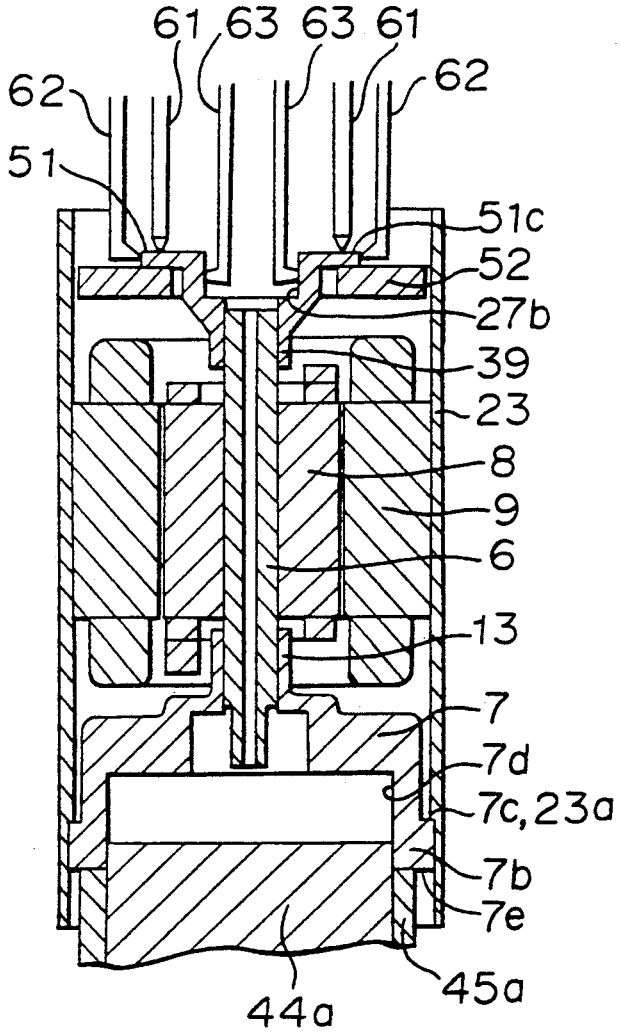
FIG. 10 is a longitudinal sectional view showing how to adjust the location of the subframe bearing part.

The compression operation in the scroll type compressor according to the second embodiment is similar to the conventional scroll type compressor. Misalignment and inclination of the bearing 39 with respect to the bearing 13 are required to fall in predetermined precision. How to assemble the frame 7, the subframe bearing part 51 and the subframe holder 52 will be explained, referring to FIGS. 5 through 7. In FIG. 5, there is shown a bottom view of the subframe. In FIGS. 6 and 7, there are shown longitudinal sectional views showing how to assemble the subframe 7 to the center shell 23. Firstly, a projection which is formed on the bearing part 51 is previously inserted in a hole 52*c* which is formed in the holder 52, and the bearing part 51 is fixed to the holder 52 by bolts (not shown). During this fixing process, e.g. a jig (not shown) is used to position the bearing part 51 and the holder 52 in a coaxial state, and to match reference apertures 51*b* and 52*b* which have been formed in the bearing part 51 and the holder 52, respectively, to have the same diameter, as shown in FIG. 5. Three screwed holes 52*a* which are formed in the holder 52 have been arranged in such a manner that they are located at the center of three holes 51*a* formed in the bearing part 51 when the reference apertures 51*b* and 52*b* have matched together. Bolts are tightened in the screwed holes 52*a* to fix the bearing part 51 to the holder 52. The electric motor stator 9 and the frame 7 have been previously shrinkage fitted to the center shell 23. The electric motor rotor 8 is inserted into the center shell 23 in such a state that the end of the center shell 23 adjacent to the frame 7 faces downward. The center shell 23 is placed onto the table 45*a* to put the concentric assemblage jig 44*a* into engagement with the concentric assemblage jig mounting surface 7*d* of the frame 7, and to put the fixed scroll mounting surface 7*e* of the frame 7 onto the top surface of the table 45*a*. On the other hand, the bearing part 51 and the holder 52 which have been previously assembled as one unit are mounted onto the under surface of the table 45*b* so that the concentric assemblage jig 44*b* is put into engagement with the concentric assemblage jig mounting surface 27*b* of the bearing part 51 and a reference surface 51*c* of the bearing part 51 (remote from the bearing 39) is mounted onto the under surface of the table 45*b*. From such conditions, the table 45*b* and the concentric assemblage jig 44*b* are vertically slided to insert the holder 52 into the center shell 23 until the holder 52 is set at a predetermined height as shown in FIG. 7. The concentric assemblage jig 44*b* is formed to be movable in a horizontal surface. If the holder 52 contacts with the inner peripheral surface of the center shell 23 when the holder 52 is inserted into the center shell 23, reaction due to such contact causes the concentric assemblage jig 44*b* to move on a horizontal surface to separate the holder 52 from the center shell 23. Finally, the holder 52 is fixed to the center shell 23 by means of arc spot welding. At that time, misalignment and inclination of the bearing 39 with respect to the bearing 13 do not always fall into predetermined precision. In order to place the misalignment and the inclination into the predetermined precision, the bolts which have fixed the bearing part 51 to the holder 52 are slackened for a time, the location of the bearing part 51 is adjusted, and then the bolts are tightened again to fix the bearing part 51 to the holder 52. An adjusting method which is conduct such adjusting will be explained, referring to FIGS. 8 through 10. Allowances for the misalignment e of and the inclination $\psi$ of the bearing 39 with respect to the bearing 13 are determined by two conditions, i.e. geometrical interference of the bearings 13 and 39, and load capacities of the bearings 13 and 39, and are not independent each other. For example, in a two-dimensional model shown in FIG. 8, if $\psi=\psi_o$, there is no geometrical interference for $\epsilon=\epsilon_o$ whereas there is geometrical interference for $\epsilon=-\epsilon_o$, and no satisfaction is established. It means that if the extent and the direction of $\psi$ are determined, a two-dimensional acceptable range for $\epsilon$ can be accordingly determined. Referring now to FIG. 9, there is shown a sample of the two-dimensional acceptable range of $\epsilon$. FIG. 9 shows that if $\psi=0$, the acceptable range of e is one within a circle, and that if $\psi=\psi_o$, the acceptable range is one within a distorted curve which is eccentric from the center of the bearing 13. If the extent of $\psi$ is lower than a certain value, the range within the distorted curve becomes relatively greater. If $\epsilon$ and $\psi$ are considered as independent values, the acceptable range of $\epsilon$ for e.g. $|\psi|<\psi_o$ is one within a circle shown by a dotted line in FIG. 9, which is extremely small. In order to adjust the location of the bearing part 51, the relationship between $\epsilon$ and $\psi$ mentioned above is utilized. As shown in FIG. 10, an inclination $\psi$ of the reference surface 51*c* of the bearing part 51 is firstly measured by three electric micrometers 61. Next, the bearing part 51 is clamped by clamp claws 62, and while the concentric assemblage jig mounting surface 27*b* of the bearing part 51 is measured by three electric micrometers 63, the clamp claws 62 are horizontally moved until the value indicative of $\epsilon$ calculated from the value measured by the three electric micrometers 63 falls into an acceptable range which is determined based on the value indicative of $\psi$. As a prerequisite therefore, coaxiality of the concentric assemblage jig mounting surface 7*d* with respect to the bearing 13, perpendicularity of the fixed scroll mounting surface 7*e* with respect to the bearing 13, coaxiality of the concentric assemblage jig mounting surface 27*b* with respect to the bearing 39, and perpendicularity of the reference surface 51*c* with respect to the bearing 39 are required to fall into the predetermined precision.

In accordance with the second embodiment, the mounting position of the subframe bearing part to the subframe holder can be adjusted to adjust misalignment of the subframe bearing with respect to the frame bearing.

In accordance with the second embodiment, the bearing in the subframe bearing part is arranged to be coaxial with the outer diameter of the subframe holder, and the subframe bearing part is mounted to the subframe holder in such a manner that the screwed holes in the subframe holder are located at the centers of the holes in the subframe bearing part.

In addition, in accordance with the second embodiment, the inclination angle and the inclination direction of the bearing in the subframe bearing part with respect to the frame bearing can be measured, the two-dimensional acceptable range for misalignment of the subframe bearing part is determined depending on the measured values, and the bearing part is mounted to the holder so that the misalignment falls into the acceptable range.

Figure 11:
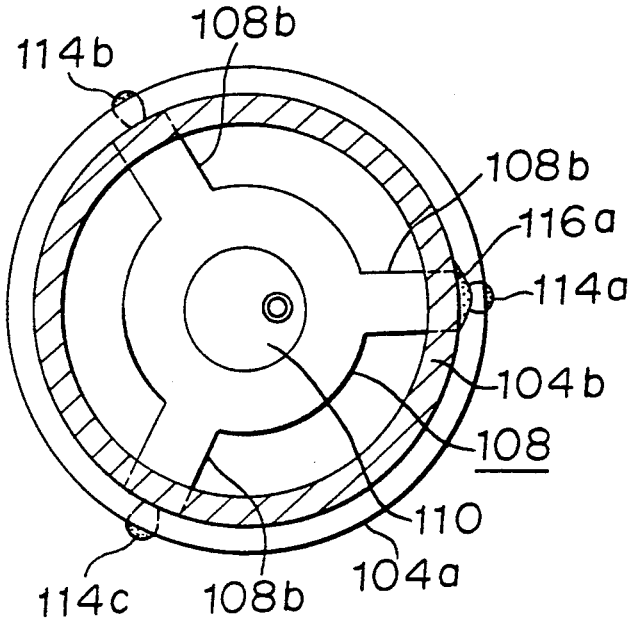
FIG. 11 is a sectional view showing the essential parts of the scroll type compressor according to a third embodiment of the present invention.
Figure 12:
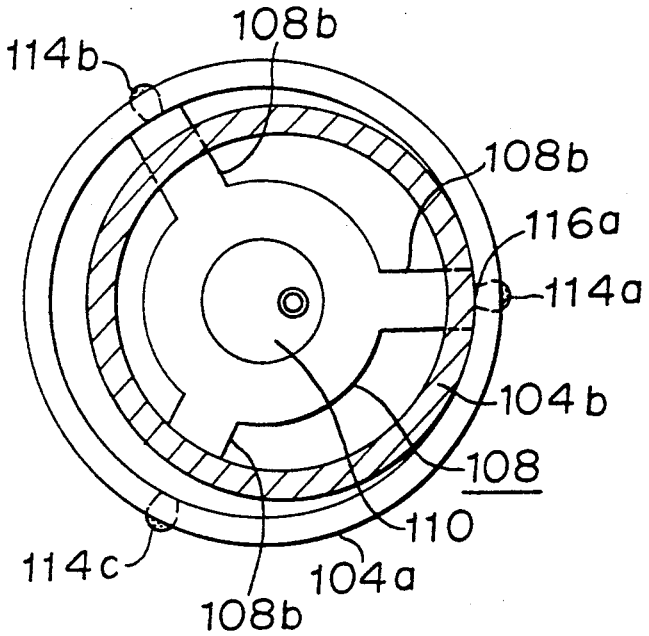
FIG. 12 is a sectional view showing the state where subframe welding starts.
Figure 13:
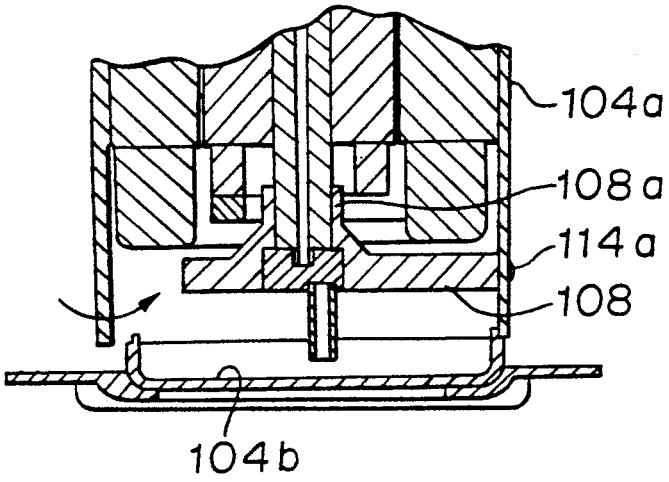
FIG. 13 is a sectional view showing deformation at the time of welding the center shell according to the third embodiment.
Figure 14:
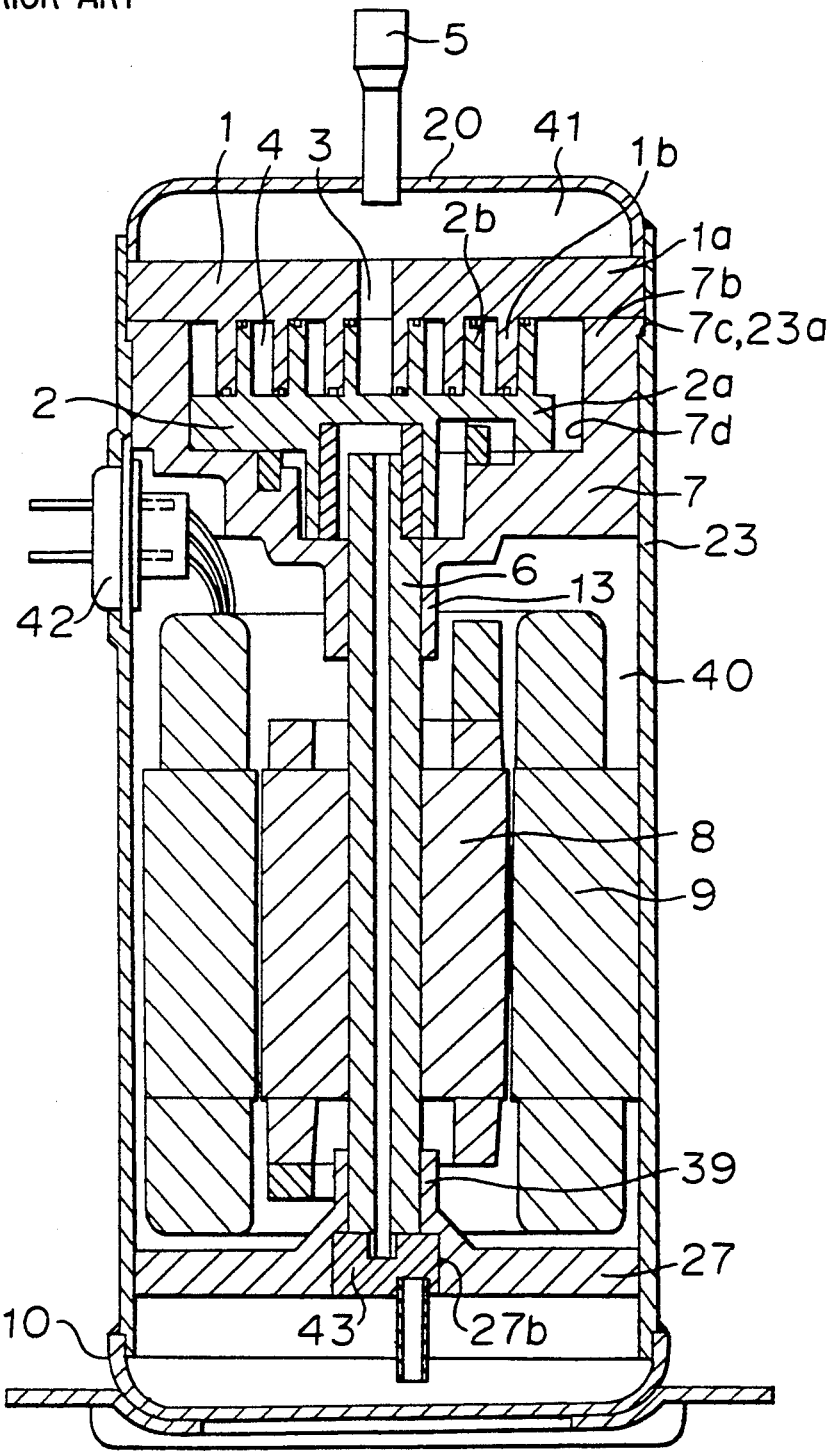
FIGURE 14 PRIOR ART
FIG. 14 is a longitudinal sectional view showing a conventional scroll type compressor.
Figure 15:
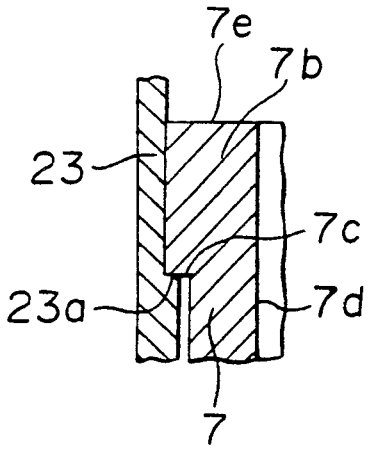
FIGURE 15 PRIOR ART
FIG. 15 is an enlarged view showing the essential parts of the conventional scroll type compressor.
Figure 16:
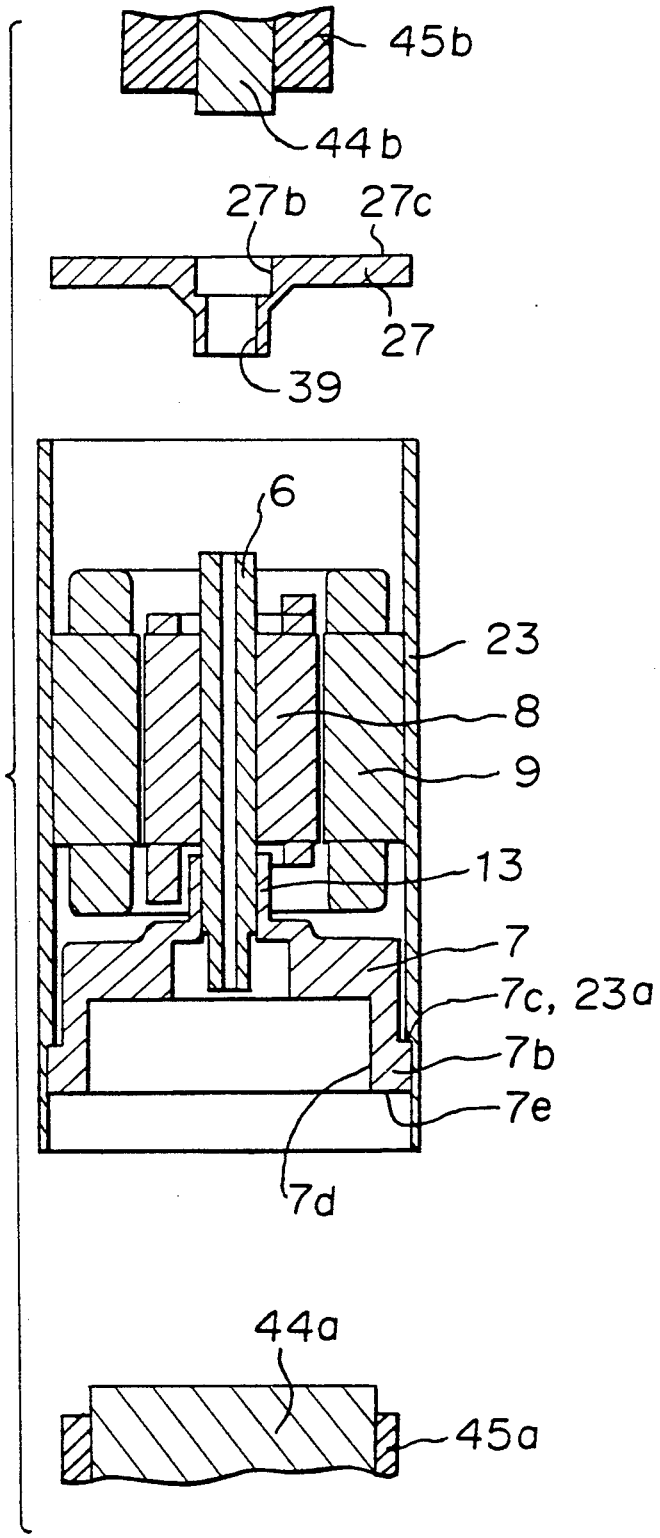
FIGURE 16 PRIOR ART
FIGS. 16 and 17 are longitudinal sectional views showing how to assemble the conventional scroll type compressor.
Figure 17:
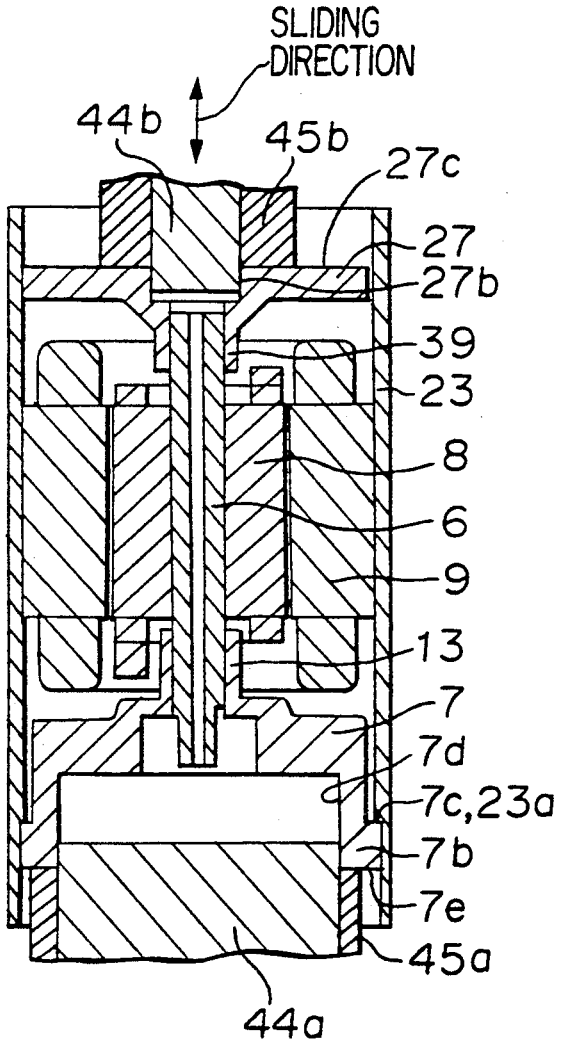
FIGURE 17 PRIOR ART
Figure 18:
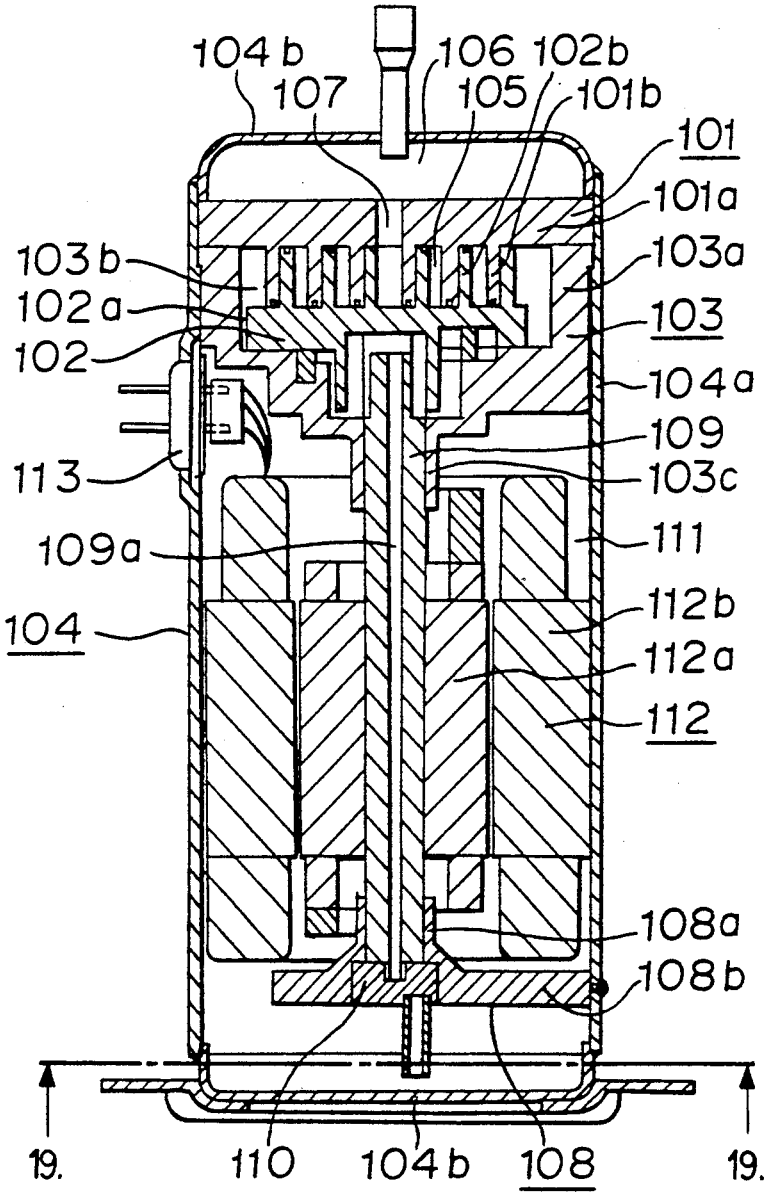
FIGURE 18 PRIOR ART
FIG. 18 is a longitudinal sectional view showing the entire structure of another conventional scroll type compressor.
Figure 19:
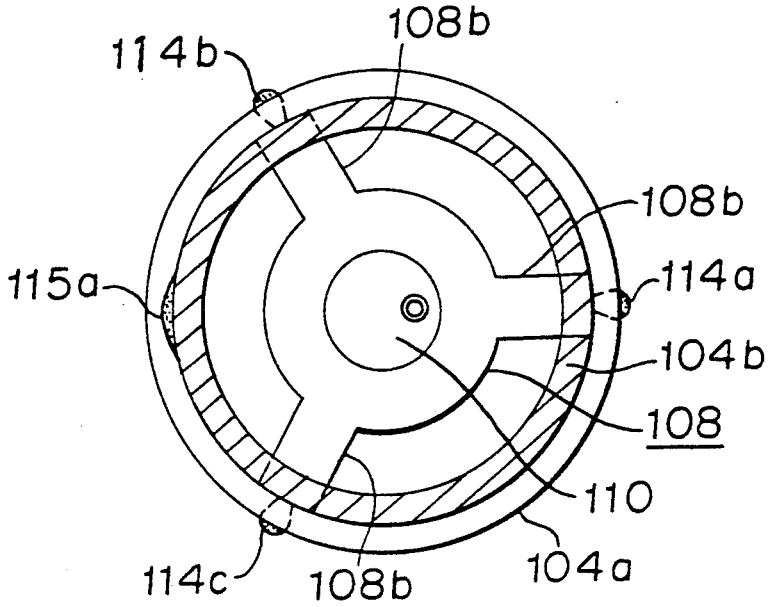
FIGURE 19 PRIOR ART
FIG. 19 is a sectional view showing the section taken along the line 19—19 of FIG. 18.
Figure 20:
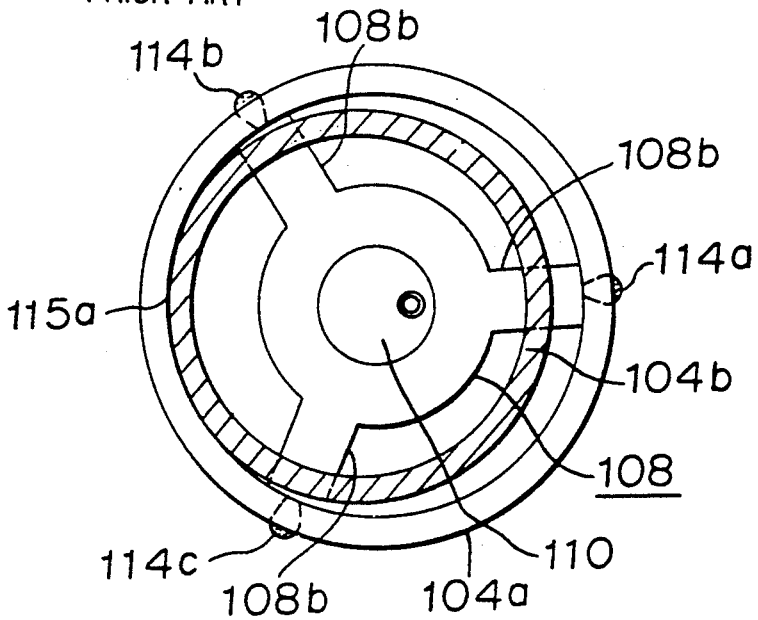
FIGURE 20 PRIOR ART
FIG. 20 is a sectional view showing the state at the time of welding the subframe in the scroll type compressor of FIG. 18.
Figure 21:
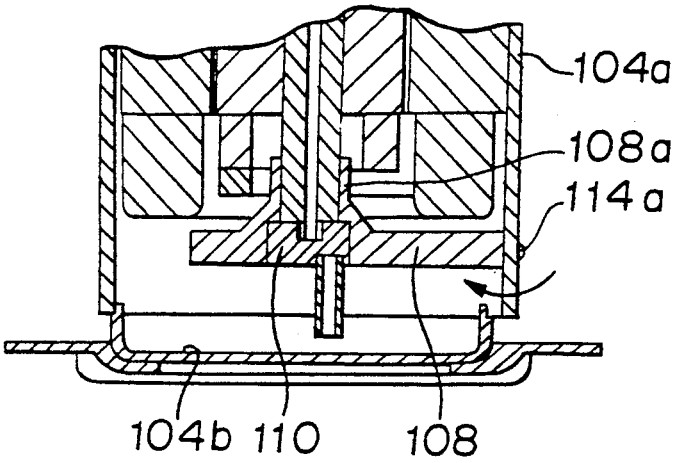
FIGURE 21 PRIOR ART
FIG. 21 is a sectional view showing deformation at the time of welding the center shell in the scroll type compressor of FIG. 18.

Referring now to FIGS. 11 through 13, there is shown a third embodiment of the present invention. In FIG. 11, there is shown a sectional view showing the essential parts of the scroll type compressor according to the third embodiment of the present invention, and corresponds to FIG. 19 with respect to the conventional scroll type compressor. The scroll type compressor according to the third embodiment is different from the conventional scroll type compressor of FIG. 18 in that the starting point 116*a* of welding for fixing the end shell 104*b* to the center 104*a* is located in the same direction as the welding point 114*a* of spot welding for fixing the subframe 108 to the center shell 104*a* as shown in FIG. 11.

Assemblage for the scroll type compressor of the third embodiment which is constructed above is similar to that for the conventional scroll type compressor. Firstly, the subframe 108 with radial ribs 108*b* is inserted to a predetermined position along the inner peripheral wall of the center shell 104*a*, and the ribs 108*b* and the center shall 104*a* are fixed together by arc spot welding. Next, the end shell 104*b* is press fitted into the center shell 104*a* in a right manner, and then a single welding torch is used to sealingly fix the circumference of the end shell 104*b* to the center shell 104*a* while moving the torch or rotating the center shall 104*a* and the end shell 104*b*.

When the end shell 104*b* and the center shall 104*a* are fixed together by arc welding, a melted metal starts solidifing from a location near to the welding starting point 116*a*. As a result, the end shell 104*b* is drawn toward the welding starting point 116*a* on the center shell 104*a*. Because the end shell 104*b* can freely shift in a radial direction in the center shall 104*a*, a gap can be formed between the end shell 104*b* and the center shell 104*a* at the side remote from the welding starting points 116*a* and 114*a* as shown in FIG. 12, thereby preventing an internal stress due to welding from occurring.

After that, the melted metal is gradually hardened along the route wherein welding progresses. As a result, portions in the center shell 104*a* are gradually drawn toward the end shell 104*b* to be deformed in such a manner that the center shell 104*a* collapses inwardly. How much the center shell 104*a* collapses inwardly is roughly proportional to the size of the gap between the end shell 104*b* and the center shell 104*a*. It means that deformation at the side opposite to the welding starting points 116*a* and 114*a*, i.e. in a direction intermediate between welding points 114*b* and 114*c* is the greatest. Although the side wall of the center shell 104*a* is deformed as indicated by an arrow in FIG. 13, the subframe 108 has small influence because the location of the greatest deformation in the center shell 104*a* is far from the welding point 114*a* between the subframe 108 and the center shell 104*a*, and the welding points 114*b* and 114*c*. As a result, coaxiality of the subframe 108 with respect to the frame 103 can be prevented from deteriorating.

Although in the third embodiment the welding starting point 116*a* on the end shell 104*b* is arranged in the same direction as the arc spot welding point 114*a* on the subframe 108, the welding starting point can be arranged in the same direction as the other arc spot welding points 114*b* and 114*c* to offer similar effects.

In accordance with the third embodiment, the welding starting point of continuous welding for fixing the center and the end shell is arranged to be in the same direction on the circumference of the center shell as one of the welding points of the spot welding for fixing the subframe to the center shell. As a result, even if the center shell is deformed due to welding of the end shell, the subframe has no significant influence, and a scroll type compressor which is capable of making the rotation of the main shaft smooth without damaging performance can be provided.

Obviously, numerous modifications and variations of the present invention are possible in light of the above teachings. It is therefore to be understood that within the scope of the appended claims, the invention may be practiced otherwise than as specifically described herein.

What is claimed is:

1. A scroll type compressor comprising:

a fixed scroll and an orbiting scroll which have their base plates provided with scroll wraps thereon, and which have the scroll wraps combined to form a compression chamber therebetween, the scroll wraps being reverse to each other in the direction in which the scroll wraps are wound;

a frame which has the oribiting scroll put thereon so as to allow the orbiting scroll to carry out orbiting movement, which has a peripheral portion formed with a flange, which has the fixed scroll fixed on the flange, which has a bearing at a central portion, and which has an outer peripheral surface formed with a stepped portion a crankshaft which is rotatably supported at its upper portion by the frame bearing to give orbiting movement to the orbiting scroll connected to the upper end of the crankshaft, and which supports an electric motor rotor at a central portion;

a subframe which has a central portion formed with a bearing for rotatably supporting the crankshaft at its lower end;

a center shell which has an upper inner peripheral surface formed with a first stepped portion engageable with the stepped portion in the frame, which has the frame shrinkage fitted thereto, which has a glass terminal below the first stepped portion, which has an electric motor stator fixed below the glass terminal, and which has the subframe fixed below the electric motor stator;

shells which are connected to both ends of the center shell to form a hermetic housing; and the hermetic housing divided into a high pressure space and a low pressure space at a boundary which is formed by the shrinkage fitted portions of the center shell and the frame;

the center shell including a lower inner peripheral surface formed with a second stepped portion, the first stepped portion in the upper inner peripheral surface and the second stepped portion in the lower inner peripheral surface are formed to keep predetermined parallelism and coaxiality, and the subframe is fixed to the second stepped portion in the lower inner peripheral surface;

wherein the first stepped portion includes two inner diameters of the center shell with a larger of the two diameters axially away from a center of the center shell with respect to a smaller of the two diameters of the first stepped portion, and wherein said second stepped portion also includes two inner diameters of the center shell with a larger of the two diameters axially away from the center of the center shell with respect to a smaller of the two diameters of the second stepped portion.

* * * * *